US005554089A

United States Patent [19]

Jones

[11] Patent Number: 5,554,089

[45] Date of Patent: Sep. 10, 1996

[54] MILITARY PRESS EXERCISE MACHINE

[75] Inventor: Gary A. Jones, Falmouth, Ky.

[73] Assignee: Hammer Strength Corporation, Cincinnati, Ohio

[21] Appl. No.: 307,510

[22] Filed: Sep. 16, 1994

[51] Int. Cl.[6] ..... A63B 21/06

[52] U.S. Cl. ..... 482/97; 482/100; 482/93; 482/92

[58] Field of Search ..... 482/97, 98, 137, 482/93, 94, 111, 126, 100, 92, 133

[56] References Cited

U.S. PATENT DOCUMENTS

| | | | |
|---|---|---|---|
| D. 321,025 | 10/1991 | Jones . | |
| D. 321,026 | 10/1991 | Jones . | |
| D. 321,027 | 10/1991 | Jones . | |
| D. 321,028 | 10/1991 | Jones . | |
| D. 321,387 | 11/1991 | Jones . | |
| D. 321,389 | 11/1991 | Jones . | |
| D. 321,390 | 11/1991 | Jones . | |
| D. 321,391 | 11/1991 | Jones . | |
| 4,387,893 | 6/1983 | Baldwin . | |
| 4,405,128 | 9/1983 | McLaughlin et al. | 482/97 |
| 4,456,245 | 6/1984 | Baldwin . | |
| 5,044,631 | 9/1991 | Jones . | |
| 5,044,632 | 9/1991 | Jones . | |
| 5,050,873 | 9/1991 | Jones . | |
| 5,066,003 | 11/1991 | Jones . | |
| 5,066,004 | 11/1991 | Jones . | |
| 5,106,080 | 4/1992 | Jones . | |
| 5,125,881 | 6/1992 | Jones . | |
| 5,135,449 | 8/1992 | Jones . | |
| 5,135,456 | 8/1992 | Jones . | |
| 5,171,198 | 12/1992 | Jones . | |
| 5,180,354 | 1/1993 | Jones . | |
| 5,181,896 | 1/1993 | Jones . | |
| 5,273,505 | 12/1993 | Jones . | |

OTHER PUBLICATIONS

Hammer Strength, Strength Jammer Summer 1990 (4 pages).

Hammer Strength, Hammer: First In Strength, (12 pages).

Leverage Machines by Nautilus, Instruction Manual (24 pages).

Hammer Brochure 1993, 24 pages.

Hammer 2–sided single page brochure Ground Base.

Hammer 2–sided single page brochure Champions.

*Primary Examiner*—Jerome Donnelly

*Attorney, Agent, or Firm*—Wood, Herron & Evans, P.L.L.

[57] ABSTRACT

A military press exercise machine for exercising the arms independently against a selected weight resistance includes a frame symmetric with respect to a midplane, a seat connected to the frame to define a declined exercise position for an exerciser, and a pair of levers with rearward ends pivotally connected to the frame on opposite sides of the midplane, above and behind the exercise position. Hubs located near the forward ends of the levers are adapted to hold weighted plates to resist upward movement of the forward ends of the levers with respect to the pivot connections. Handles located adjacent forward ends of the levers are adapted to be grasped by an exerciser in the exercise position and then raised upwardly in a military press motion against the weight of the plates. During upward movement, the handles move toward the midplane. When the arms are extended, the handles reside above the pivot connections of the levers. At the beginning and at the end of the exercise motion, the handles reside substantially in a single transverse vertical plane which is perpendicular to the midplane. A second set of hubs may be used at the extreme rearward ends of the levers to achieve overall zero weight resistance, or to provide "inverted resistance". This military press exercise machine is safe, effective and the weight resistance is known with certainty.

14 Claims, 4 Drawing Sheets

MILITARY PRESS EXERCISE MACHINE

FIELD OF THE INVENTION

This invention relates to an exercise machine, and more particularly to an exercise machine with at least one lever moved by an exerciser through a military press exercise motion.

BACKGROUND OF THE INVENTION

Exercise machines generally provide safety advantages over exercising with free weights. However, some exercisers prefer the look and feel of exercising against a weight resistance provided by weighted plates, dumbbells or barbells. Thus, lever-type exercise machines which use weighted plates have been popular.

There are also other types of exercise machines. For instance, exercise machines of the pulley and chain type generally have a movable lever connected to an end of a chain, which extends around at least one pulley and has the other end secured to a selectorized weight stack, or a hub for holding weighted plates. Unfortunately, in addition to the selected weight from the stack or the weighted plates, these machines have inherent weight resistance due to the interaction of the movable mechanical components, particularly the chain and a meshing gear. If there is a variation in the lubrication condition of these mechanical components, this inherent weight resistance also varies. As a result, despite the amount of weight selected from a weight stack or the total weight of the plates used, an exerciser will often not know with certainty the actual value of the weight resistance he or she is exercising against. Because most exercisers prefer to monitor progress by recording the weight resistance that is exercised against, this lack of certainty represents a disadvantage. Thus, in addition to the psychological disadvantage of not simulating exercise with free weights, machines of this type suffer from the practical disadvantage of uncertainty in weight resistance.

In addition to these aspects of exercise machines, perhaps the most important aspect of any exercise machine is that it provide optimum muscular benefit for a particular exercise motion, without sacrificing safety.

Applicant has developed a substantial number of exercise machines which achieve these goals with respect to corresponding exercise motions. Generally, applicant has done this by utilizing a weighted lever adapted to move in a plane of motion, or oriented such that the weight resistance is directed against the movement applied by the exerciser in a way which accommodates the natural musculoskeletal makeup of the human body, For instance, applicant's incline press exercise machine optimally accommodates the performance of an incline press. The incline press motion involves extension of the arms from a retracted position in front of the chest to an extended position just above the face of the exerciser. During the motion, the arms move along planes which converge forwardly with respect to the position faced by the exerciser. The motion is primarily outward from the body and slightly upwardly.

Similarly, applicant has developed a bench press exercise machine, a decline press exercise machine and a behind the neck exercise machine which are adapted to accommodate the unique exercise motions implied by these names, and each of these exercise machines is adapted to naturally accommodate the musculoskeletal makeup of an exerciser with respect to these exercise motions.

None of these machines are adapted to accommodate a military press exercise motion. The military press motion is an important exercise motion to a substantial number of exercisers. Along with the bench press, the squat and perhaps the dead lift, the military press has been generally regarded as one of the most important strength training exercises. In a military press exercise motion, the exerciser extends the arms upwardly from a retracted position in front of the chest to an arm-extended position above the head. The motion is generally parallel to the torso of the exerciser, though it may be angled somewhat forwardly due to the natural tendency of the exerciser to move his or her head in a rearward direction as the back arches under relatively heavy weight resistance.

SUMMARY OF THE INVENTION

It is an objective of this invention to optimize the muscular benefits achieved via performance of a military press exercise motion.

It is another objective of this invention to enhance the safety of performing a military press exercise motion.

It is still another objective of this invention to improve certainty in determining the amount of weight resistance that is exercised against for an exerciser performing a military press exercise motion.

The above-stated objectives are achieved by a military press exercise machine with at least one lever pivotally connected to a frame so that an exerciser located in an exercise position defined by the frame may grasp and pivotally raise a weighted forward end of the lever with respect to a pivotally connected rearward end, such that the forward end is located above the pivot connection when the arm is fully extended upwardly. Although the motion is arcuate because of the pivotal connection, due to the length of the lever and the location of the pivot connection above and behind the exerciser, the forward end of the lever moves through an arc which closely simulates the motion of the hands of an exerciser performing a military press exercise with a free weight loaded dumbbell. That is, if two levers are used simultaneously, the hands move in almost the same manner that they would move if the exerciser were performing the exercise with a dumbbell.

With this machine, the hands start and finish in substantially the same transverse vertical plane, which is oriented perpendicular to the forward facing plane of the exerciser. As the arms are extended upwardly, the hands move closer together due to an inward tilt of the planes of motion of the levers. However, during the motion, the hands and handles move primarily upwardly. Also, the palms of the exerciser rotate inwardly during upward and inward movement.

If desired, in addition to weighting the forward end of the levers to provide a predetermined resistance to upward pivotal movement, the rearward ends of the lever may also be weighted, via counterweight hubs to provide assistance to upward movement, which may be referred to as inverted resistance. This inverted resistance may be used to exactly offset the upward resistance of the forward ends and thereby provide zero effective weight resistance. With this feature, very little or no weight resistance can be exercised against. This is particularly desirable for exercisers who are rehabilitating an injury, or perhaps even for elderly and/or physically handicapped exercisers, wherein performance of the motion itself is more important than moving a large amount of weight.

The counterweight hubs also enable an exerciser to readily calibrate or zero out the lever so that the magnitude of any additional weight resistance added to the forward ends thereof is known with certainty and the amount of weight resistance is repeatable.

According to a preferred embodiment of the invention, a military press exercise machine includes a frame symmetric with respect to a vertical midplane therethrough, a declined seat for locating an exerciser in an exercise position straddling the midplane and facing a forward direction therealong, and two levers located on opposite sides of the midplane, each lever having a rearward end pivotally connected to the frame above and behind the seat and a forward end with a hub for holding a selected number of weighted plates and a handle adapted to be grasped by the exerciser. Each lever also includes a counterweight hub located at the extreme rearward end thereof to provide the inverted resistance previously described.

The levers are movable through planes which tilt inwardly toward the midplane, and diverge in the forward direction, and the pivot axes of the levers have a corresponding inward tilt. This causes the handles to converge together when the forward ends of the levers are pivotally raised to positions above the respective pivot axes. However, because of the lengths of the levers and the locations of the pivot axes, for each lever the handle starts and finishes in substantially the same transverse vertical plane, which is oriented perpendicular to the midplane. Because the levers are independent, an exerciser supported in the exercise position may exercise both arms independently, either via a simultaneous motion or alternate motion. This represents an improvement over performance of a military press with a free weight loaded barbell, which requires use of both arms at all times.

This invention also represents an improvement over the use of separate dumbbells for independent arm performance of the military press exercise motion, because the pivotally connected levers require the resistance to be applied against the exerciser in desired planes of motion which are most suited to resisting these relatively large weight resistances. To the contrary, with free-weight dumbbells, there is a tendency for heavy weights to pull the arms and shoulders outwardly, thereby placing a substantial amount of stress on the shoulders. This invention eliminates that problem.

In addition to enhanced safety due to confining the applied weight resistances to the desired planes of motion, the declined seat fully and rigidly supports the back and bottom of the exerciser, thereby preventing the well-known and potentially harmful bowing and straining that sometimes accompanies the performance of a military press exercise motion with heavy weights.

These and other features of the invention will be more readily understood in view of the following detailed description and the drawings.

DETAILED DESCRIPTION OF THE DRAWINGS

FIGS. 1–4 show a preferred embodiment of the invention, a military press exercise machine 10. This military press exercise machine 10 is constructed of a plurality of interconnected straight or curved and/or bent metal pieces, similar to the exercise machines disclosed in applicant's other issued U.S. Pat. Nos. such as 5,044,631; 5,044,632 ; 5,050,873; 5,135,449; 5,135,456; and 5,181,896. Primarily, this military press exercise machine 10 includes a frame 12 which accommodates an exerciser 13 in the performance of a military press exercise motion. The frame 12 is symmetric with respect to a midplane 14, which is preferably oriented vertically, and the frame 12 orients the exerciser 13 in an exercise position straddling the midplane 14 and facing a forward direction therealong.

Figure 1:
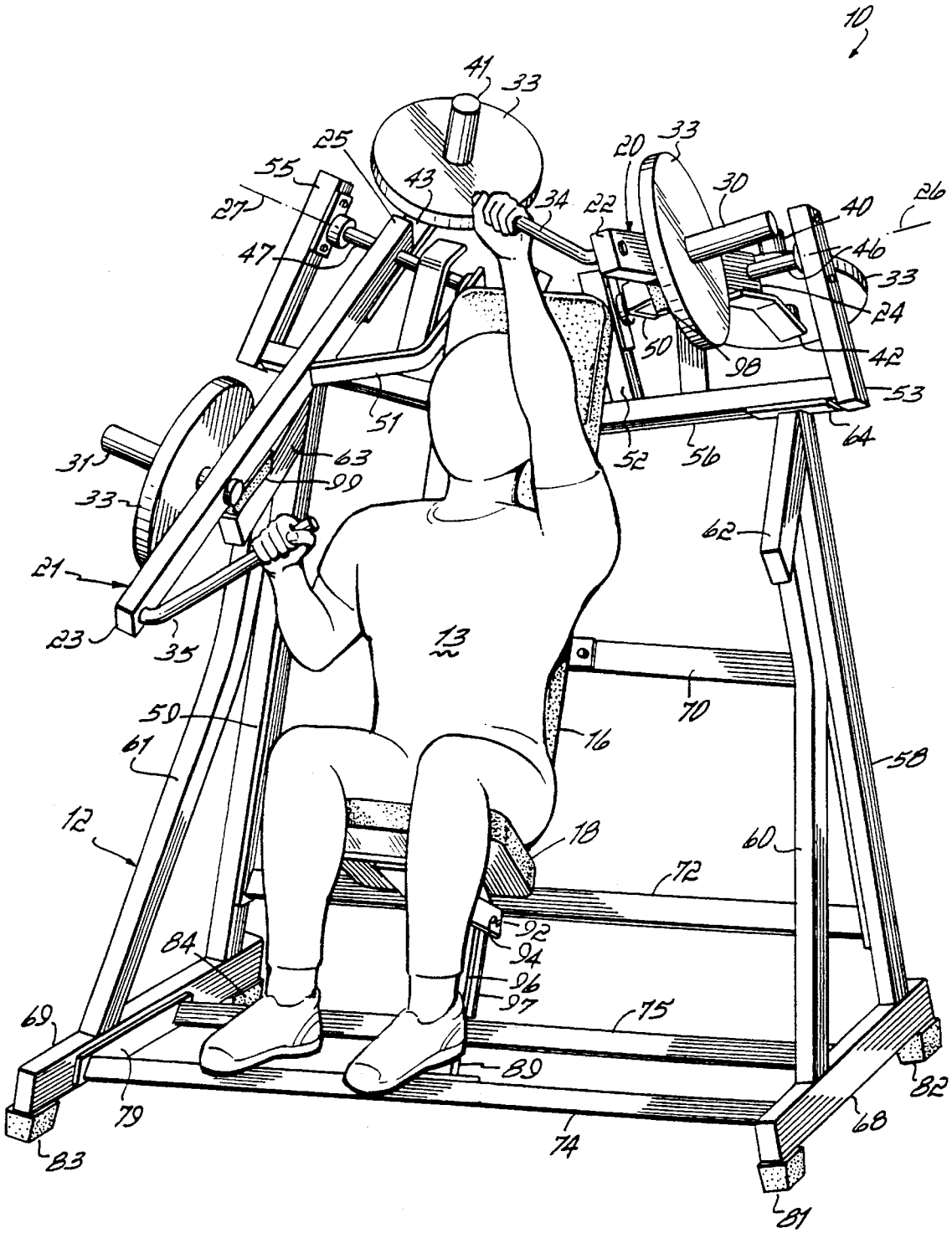
FIG. 1 is a perspective view of a military press exercise machine constructed in accordance with a preferred embodiment of the invention, with an exerciser supported thereon and performing a military press exercise.

As shown in FIG. 1 the exercise position occupied by the exerciser 13 is defined by a declined seat, which comprises a back supporting member 16 and a bottom supporting member 18. If desired, the frame 12 may be designed to accommodate performance of a military press exercise motion from one or more of a number of other exercise positions, such as standing or kneeling.

Figure 3:
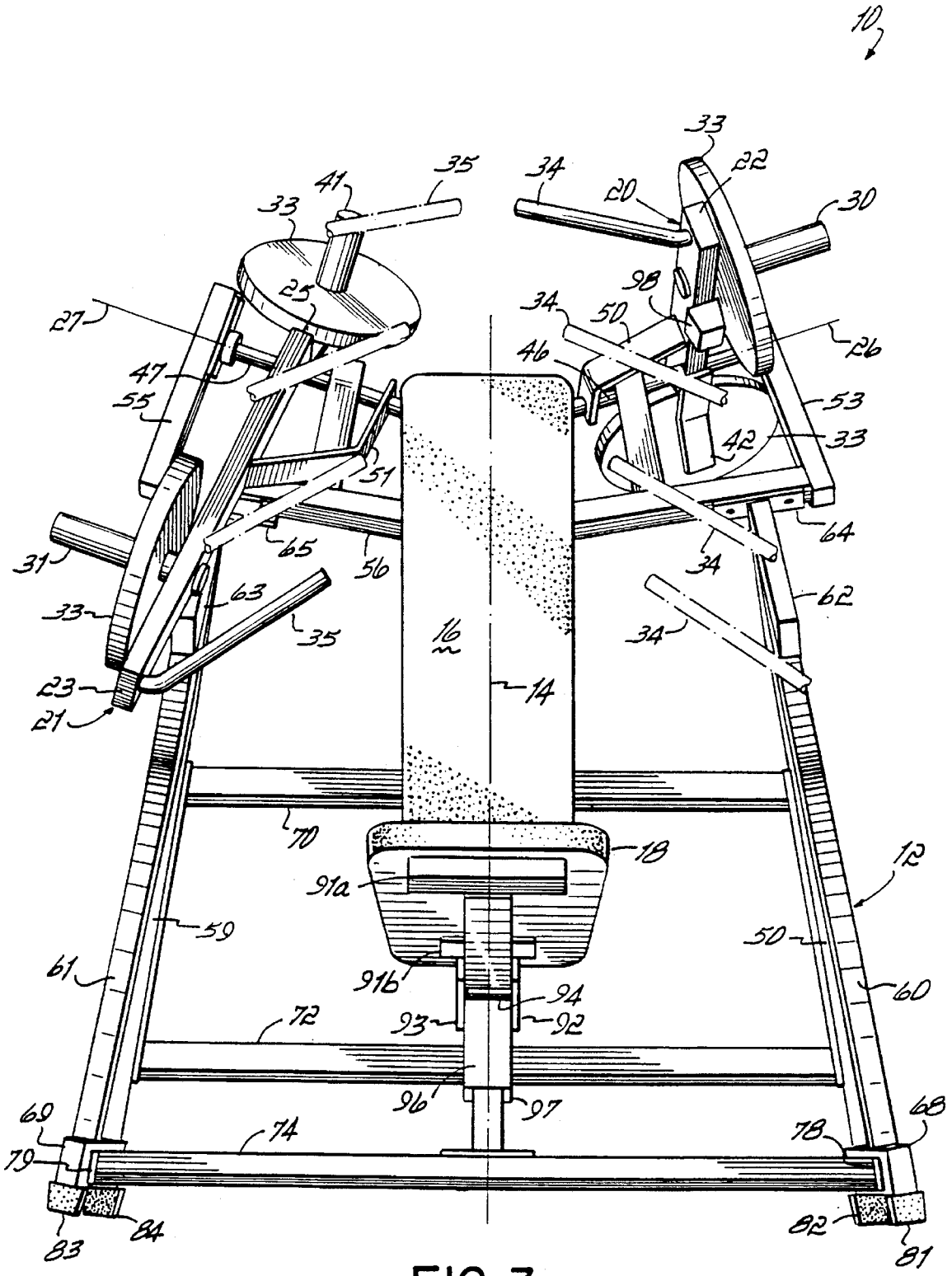
FIG. 3 is a front view of a military press exercise machine constructed in accordance with a preferred embodiment of the invention, with the handle positions shown for various stages of the military press motion.
Figure 4:
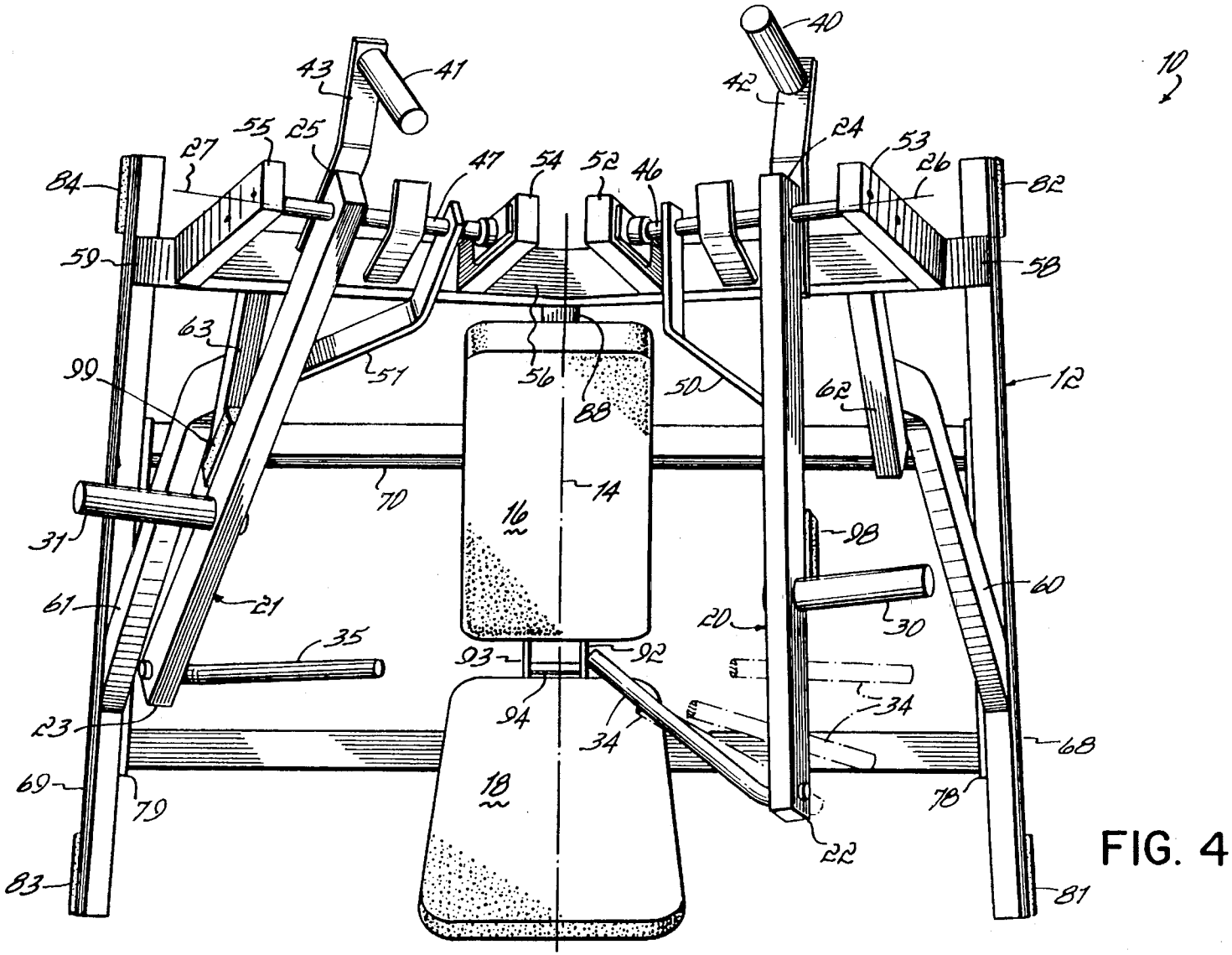
FIG. 4 is a plan view of a military press exercise machine constructed in accordance with a preferred embodiment of the invention, with the handle positions shown for various stages of the military press motion.

The frame 12 further includes a pair of levers 20 and 21 pivotally connected to the frame 12 on opposite sides of the midplane 14. Levers 20 and 21 include forward ends 22 and 23, respectively, and rearward ends 24 and 25. The levers 20 and 21 are pivotally connected to the frame 12 along pivot axes 26 and 27, respectively, both of which tilt downwardly from horizontal toward the midplane 14 as shown in FIG. 3 and are angled forward toward the midplane 14 as shown in FIG. 4. For each of the levers 20 and 21, the pivot connection along the pivot axis 26 and 27, respectively, is located adjacent the respective rearward end 24 and 25.

The levers 20 and include hubs 30 and 31 located adjacent forward ends 22 and 23, respectively. Hubs 30 and 31 are adapted to hold a selected number of weighted plates 33 to provide a weight resistance to pivotal movement of the respective lever 20 or 21 about the respective pivot axis 26 or 27. As shown in FIG. 1, each of levers 20 and 21 includes a single weight plate 33, although it is to be understood that more or less plates 33 of the same or different weights may be added or removed, depending upon the desired weight resistance. Additionally, if desired, instead of using weight holding hubs 30 and 31, the frame 12 may be adapted for applying a desired weight resistance in another manner, as by a selectorized weight stack which co-acts with the lever or levers 20 and 21 via a pulley and cable arrangement. While it is preferred to use weighted plates 33, such alternative structures for applying a predetermined weight resistance to the forward ends 22 and 23 of the levers 20 and 21 would be suitable, so long as such alternative structures are sufficient for enabling the exerciser 13 to apply a resistance which is known with certainty.

Figure 2:
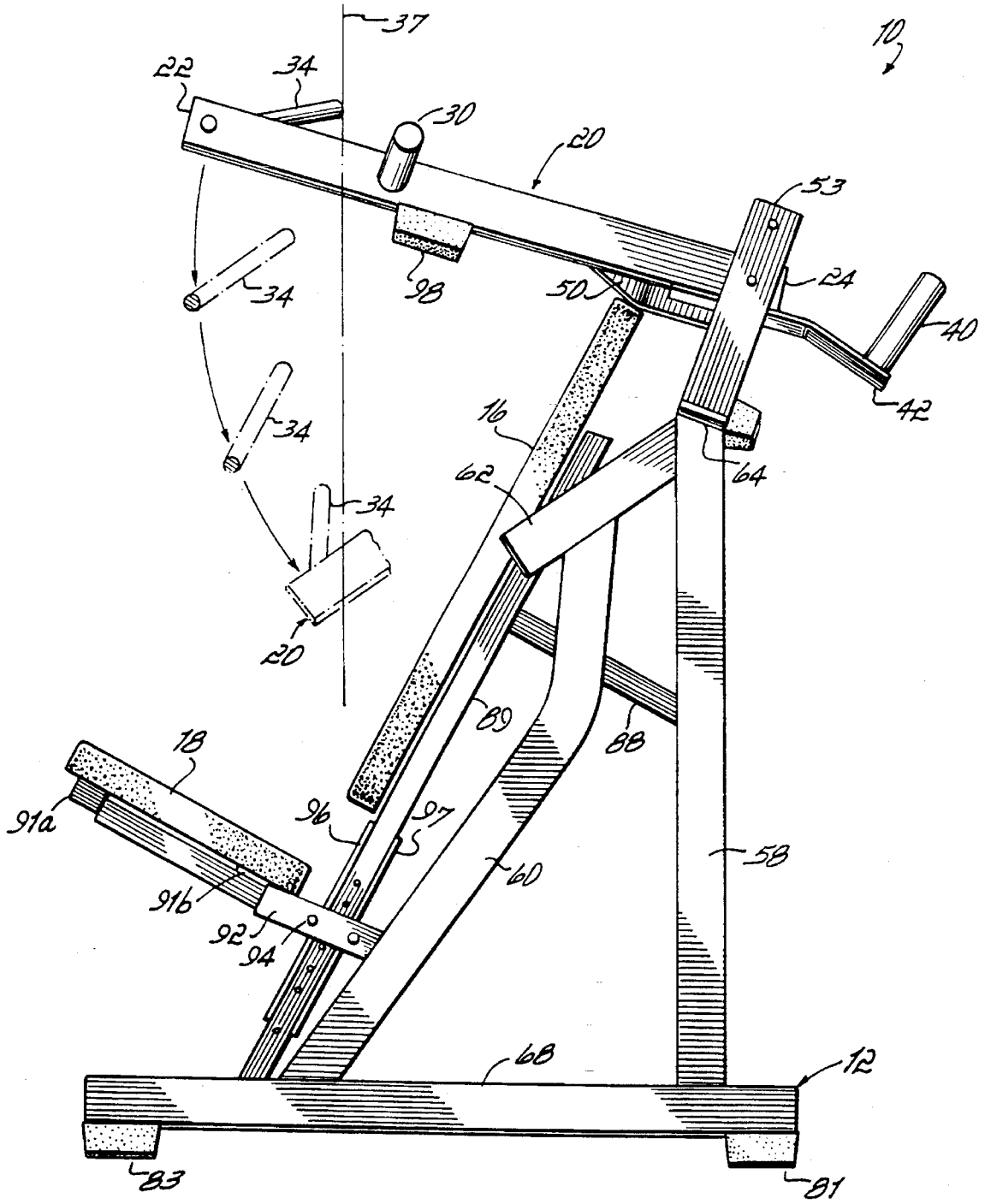
FIG. 2 is a side view of a military press exercise machine constructed in accordance with a preferred embodiment of the invention, with only one of the levers shown, for simplicity, and with the handle positions for the lever shown for various stages of the military press motion.

Handles 34 and 35 are also located adjacent the forward ends 22 and 23, respectively, of the levers 20 and 21. The handles 34 and 35 are located closer to the forward ends 22 and 23, respectively, than the hubs 30 and 31. Each of the handles 34 and 35 is adapted to be grasped by the exerciser 13 located in the exercise position and moved upwardly in a military press exercise motion against the selected weight resistance held by the hub 30 or 31. This motion pivotally moves the forward end 22 or 23 of the lever 20 or 21 to a final arm-extended position wherein the handle 34 or 35 is located above the pivot connection of the respective lever 20 or 21 (FIG. 2).

In FIG. 1, the left arm of the exerciser 13 is in the arm extended position, with the handle 34 located above the pivotal connection where the lever 20 is connected to the frame 12, while the right arm is in an arm retracted position, with the handle 35 located below the pivot connection of the lever 21. Thus, FIG. 1 shows independent arm movement for the exerciser 13. Although such independent motion is shown and is preferred so as to enable the exerciser 13 to perform simultaneous or alternative independent exercise of both arms, it is also to be understood that the levers 20 and 21 may be operatively connected in a manner which would require simultaneous raising of both arms.

Because the axes of connection 26 and 27 of the levers 20 and 21, respectively, tilt downwardly and forward toward the middle vertical midplane 14, the handles 34 and 35 move through forward diverging planes which tilt inwardly toward the midplane 14 during upward arm extension by the exerciser 13. Additionally, as best shown in FIG. 2, at the beginning and at the end of the military press motion, the handles 34 and 35 reside substantially in a single transverse vertical plane 37 which is perpendicular to the vertical midplane 14.

Preferably, the levers 20 and 21 also include rear hubs 40 and 41, respectively. These rear hubs 40 and 41 are located at the extreme ends 24 and 25 of the levers 20 and 21, respectively. Each of these rear hubs 40 or 41 is also adapted to hold a selected number of weighted plates 33. However, as opposed to providing a selected weight resistance to upward movement of the handle 34 or 35 during the military press exercise motion, the weight resistance applied to the levers 20 and 21 via weighted plates 33 held at rear hubs 40 and 41 provides a weight assistance during the upward military press motion, i.e., during arm extension. However, this weight assistance becomes a weight resistance when the arms are retracted downwardly by the exerciser 13 back to the original starting position, with the handles 34 and 35 down and in front of the chest of the exerciser.

In effect, weighted plates 33 held by the rear hubs 40 and 41 provide a counter-weight effect, if the exerciser 13 desires to perform a military press exercise motion in an "inverted" manner, as is sometimes done with exercise machines. Additionally, and perhaps more importantly, the counterweighting hubs 40 and 41 enable the exerciser 13 to "zero out" the weight resistance applied by the forward hubs 30 and 31, or to cancel out all but a known and variable weight resistance held at the forward hubs 30 and 31. This provides the exerciser 13 a great deal of versatility in selecting a variable weight resistance to exercise against, and even zero weight resistance, if desired, when initially beginning a rehabilitation program where performance of the motion may be considered a major step on the road to recovery. To support the counterweight hubs 40 and 41, the levers 20 and 21, respectively, may be extended further rearwardly, or extenders 42 and 43 may be secured to the undersides of the levers 20 and 21, respectively, adjacent the pivot connections.

In addition to levers 20 and 21 and extenders 42 and 43, the pivoting structure on each side of the midplane 14 further includes an axle 46 or 47 and a brace 50 or 51. The ends of the axle 46 connect to uprights 52 and 53, and the ends of the axle 47 connect to uprights 54 and 55. Like the tilted planes through which the levers 20 and 21 move, these uprights 52, 53, 54 and 55 tilt downwardly from vertical toward the midplane 14. The ends of the axles 46 and 47 are connected to the uprights via bearings, which may be a bearing sold by SST under the Model No. FTN 205D, or a functionally equivalent bearing of the type disclosed and described in applicant's other issued U.S. patents, namely a pillow block bearing sold by Browning under part No. VF2S which requires one shot of lubricating oil per year.

The uprights 52–55 extend upwardly from an upper center support member 56, which is angled or bent at its intersection with midplane 14 in an upward direction to accommodate the inward tilt of the axles 46 and 47. Preferably, each of axles 46 and 47 tilts downwardly at an angle of about 19°. On the left side of the machine 10, as viewed by the exerciser 13, an end of the support member 56 is supported by the rear leg 58, front leg 60 and a connector 62 extending therebetween. The rear leg 58 secures to the member 56 via an end plate 64. Similarly, on the right side of the machine, as viewed in the forward facing direction by the exerciser 13, the member 56 is supported by a rear leg 59, a forward leg 61, and a connector 63 extending therebetween, and the rear leg 59 secures to the member 56 via a base plate 65. Bottom sections 68 and 69 support the bottom ends of the legs 58–61.

As shown in FIGS. 3 and 4, the forward legs 60, 61 are separated by a greater distance than the rear legs 58, 59, so that the left and right sides of the machine including the respective bottom sections 68, 69 and respective levers 20, 21 diverge from the midplane 14 and each other in the forward direction. The frame 12 includes central rear brace 70, a lower rear brace 72, and forward bracing which includes a first member 74 located at a forward end of the frame 12 and a second member 75 located rearwardly thereof. The ends of the members 74 and 75 are connected to bottom sections 68 and 69 via end plates 78 and 79, respectively. Mountings designated by reference numerals 81–85 are secured to the four corners of the frame 12, thereby to support the frame 12 above the floor. If desired, bottom plates with bolt holes therethrough may be secured to the mountings 81–85 for securement of the frame 12 during shipping or after final installation.

As shown more clearly in FIG. 2, a center brace 88 extends forwardly and upwardly from central rear brace 70, thereby to support a declining member 89 which extends rearwardly from forward brace 74 (FIG. 1) at a declined angle. The back support member 16 secures directly to the declining member 89. The bottom support member 18 is secured to a bottom piece 90 which is connected at its forward and rearward ends to transverse pieces **91*a* and 91*b*, respectively. The bottom piece 90 is in turn secured to a pair of spaced members 92 and 93 (FIG. 3) located on opposite sides of the midplane 14. The spaced members 92 and 93 are interconnected via a pair of parallel, spaced bars 94 which intersect the vertical midplane 14. These spaced bars coact with sandwiching members 96 and 97, which mount to declining member 89, via frictional engagement, thereby to enable the bottom support member 18 to be adjusted along the declining member 89. To move the bottom support member 18, a forward end thereof is raised to move the spaced bars away from and out of frictional engagement with the sandwiching members 96 and 97. In this position, the bottom support member 18 may be moved along the declining member 89 to a desired position. When the forward end is let go, the parallel spaced bars again frictionally engage the sandwiching members 96 and 97 to hold the member 18** in place.

FIGS. 2, 3 and 4 show in phantom the positions of the handles 34 and 35 as the levers 20 and 21, respectively, are moved through the military press exercise motion. As shown clearly in FIG. 2, at the bottom of the motion and at the top of the motion, the handle 34 resides substantially in a single transverse vertical plane 37. Though not shown, this is also true of handle 35. FIG. 2 also shows a bumper pad 98 secured to the bottom of lever 20 to limit downward movement of the forward end 32 with respect to the frame 12. Similarly, lever 21 includes bumper pad 99 which coacts with the frame 12 in the same manner to limit downward movement thereof.

In use, an exerciser 13 assumes the exercise position, preferably by supporting himself or herself on the declined back support member 16 and bottom support member 18. The exercise position is assumed after a selected number of weighted plates 33 have been placed on the hubs 30 and 31, and if desired, also on hubs 40 and 41, to achieve a desired amount of weight resistance to oppose the upward military press motion. Alternatively, weight assistance, or inverted resistance may be applied solely via use of weights on hubs 40 and 41. As a further alternative, weights may be selected so as to effectively provide zero weight resistance to the exerciser 13.

To exercise, the exerciser 13 extends the arms upwardly from a flexed position in front of the chest to an arm extended position above the head, while holding the handles 34 or 35. In the arm extended position, the handles 34 or 35 are located above the axles 46 or 47, respectively. At The bottom of the motion, with the arms retracted, the handles 34 and 35 are located below the axles 46 and 47, respectively. The resistance to upward movement, or perhaps the resistance to downward movement, is determined by the amount of weight held on the hubs, as stated previously. The arms may be exercised independently of each other, either via simultaneous motion or alternate motion. As the arms move upwardly during the extending motion, the handles 34 and 35 move inwardly toward the midplane 14. Also, as best shown in FIG. 4, the palms rotate inwardly during upward movement. However, as shown in FIG. 2, the handles 34 and 35 begin and end in substantially the same transverse vertical plane 37.

With this construction, applicant has achieved an exercise machine 10 which accommodates safe and effective performance of a military press exercise motion. Because of the orientations of the levers 20 and 21 and the handles 34 and 35 with respect to the exerciser 13 while in the exercise position, the military press exercise motion of this machine 10 accommodates the natural musculoskeletal makeup of the human body. Because this machine 10 is a lever type machine, as opposed to free weights, the risk of injury while performing a military press exercise is significantly limited. On the other hand, the same look and feel of exercising with free weights is achieved, due to the use of the weighted plates 33.

Finally, due to the counterweight hubs 40 and 41, this machine 10 accommodates exercise via inverted resistance. It also provides a high degree of versatility in effectively zeroing out the weight resistance, or exercising at an extremely low weight resistance, or actually calibrating the levers 20 or 21 prior to adding additional weights 33. As indicated above, these features may be extremely important for exercisers who are rehabilitating an injury or perhaps exercisers who are elderly and/or possibly handicapped, and/or exercisers who desire to know with certainty the amount of weight resistance being exercised against. Because the handles 34 move outwardly as the levers move downwardly to their normal at rest position, the exerciser 13 in the exercise position remains free and clear of the movable components of the machine 10, in the event the handles 34 or 35 are let go and the forward ends of the levers fall forwardly.

While the present invention has been illustrated by the description of embodiments thereof, and while the embodiments have been described in considerable detail, it is not the intention of applicant to restrict or in any way to limit the scope of the appended claims to such detail. Additional advantages and modifications will be readily apparent to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A military press exercise machine comprising:

a frame defining an exercise position for an exerciser whereby the exerciser in the exercise position faces a forward direction along a vertical midplane bisecting the frame;

a lever having forward and rearward ends, each rearward end being pivotally connected to the frame so as to pivot about a pivot axis located above and behind the exercise position, the pivot axis angling downward and forward toward the midplane, and the lever extending from the pivot axis in the forward direction and laterally away from the midplane, the lever pivoting in a tilted plane converging with the midplane in the upward direction and diverging from the midplane in the forward direction;

a weight holder connected to the lever adjacent the forward end thereof, the weight holder adapted to hold a selected weight to provide a selected weight resistance, the weight holder providing the forward end of the lever a resistance to pivotal motion in the tilted plane in a generally upward direction; and a handle connected to the forward end of the lever, the handle located forward of the exercise position and spaced laterally from the midplane, the handle adapted to be grasped by an exerciser located in the exercise position and raised upwardly in a military press exercise motion against the selected weight resistance to pivotally raise the forward end of the lever above the pivot axis, the handle moving upward and toward the midplane during the motion to exercise a muscle group associated with the military press exercise motion.

2. The exercise machine of claim 1 and further comprising:

a seat connected to the frame, the seat defining a seated exercise position for performance of the military press exercise motion.

3. The exercise machine of claim 1 and further comprising:

a second weight holder connected to the rearward end of the lever, the second weight holder adapted to hold a selected number of weighted plates to provide a selected weight assistance for promoting pivotal upward movement of the forward end of the lever, and thereby enabling the lever to be weighted so that the effective weight resistance to pivotal upward movement of the forward end is zero.

4. The exercise machine of claim 1 wherein the handle extends toward the midplane and in a direction opposite the forward direction.

5. The exercise machine of claim 1 and further comprising:

a second lever identical to the first but located on an opposite side of the midplane, the levers being symmetric with respect the midplane, thereby to provide military press exercise on both sides of the midplane.

6. A military press exercise machine comprising:

a frame having a midplane;

a seat connected to the frame and adapted to locate, an exerciser in a supported exercise position facing a forward direction along the midplane;

a pair of levers having forward and rearward ends and being pivotally connected to the frame at pivot axes located on opposite sides of the midplane, each of the pivot axes being proximate the rearward end of a respective lever and angling downward and forward toward the midplane;

two handles, each handle connected to a lever adjacent the forward end thereof, each handle adapted to be grasped by an exerciser located in the exercise position and moved upwardly in a military press exercise motion to first, pivotally raise the forward end of the lever to an arm-extended position with the handle located above a respective pivot axis, and then, pivotally pull the forward end of the lever to an arm-flexed position with the handle located below the respective pivot axis, the handles moving first, closer to the midplane along a tilted plane diverging in the forward direction and converging in the upward direction during upward movement of the respective forward ends and then, away from the midplane along the tilted plane during downward movement thereof;

each of the levers further including:

a first selected weight resistance applied to the lever to resist upward movement of the forward end, and a second selected weight resistance applied to the lever to resist downward movement of the forward end.

7. The exercise machine of claim 6 wherein each first means for applying further comprises:

a hub connected to the respective lever adjacent the forward end thereof, the hub adapted to hold a selected number of weighted plates to achieve the selected weight resistance to upward movement.

8. The exercise machine of claim 6 wherein each second means for applying further comprises:

a hub connected to the respective lever adjacent the rearward end thereof, the hub adapted to hold a selected number of weighted plates to achieve the selected weight resistance to downward movement.

9. The exercise machine of claim 6 wherein, at the beginning and at the end of the military press exercise motion, the handles reside substantially in a transverse vertical plane which intersects the midplane.

10. A military press exercise machine comprising:

a frame having a vertical midplane extending in a forward direction and bisecting the frame;

a seat connected to the frame and adapted to support an exerciser in a declined exercise position straddling the midplane and facing the forward direction along the midplane;

a pair of levers located on opposite sides of the midplane, each lever having a forward end and a rearward end, each lever being pivotally connected to the frame adjacent the respective rearward end thereof and having a pivot axis located above and behind the exercise position and angling downward and forward toward the midplane;

a pair of weight holders located on opposite sides of the midplane, each weight holder located adjacent the forward end of one of the levers and providing a weight resistance to pivotal upward movement of the forward end of the one of the levers; and a pair of handles, each handle connected to one of the levers adjacent the forward end thereof, the handles adapted to be grasped by an exerciser in the exercise position and moved upwardly in a military press exercise motion against a respective weight resistance to pivotally raise the forward end of respective levers to a position above the pivot axis while moving the handles along a tilted plane diverging in the forward direction and converging in the upward direction.

11. The military press exercise machine of claim 10 wherein at the beginning and at the end of the military press exercise motion, the handles reside substantially in a transverse vertical plane which intersects the midplane.

12. The military press exercise machine of claim 10 wherein each weight holder comprises:

a hub connected to a respective lever adjacent the forward end thereof, the hub adapted to hold a selected number of weighted plates to achieve the predetermined weight resistance.

13. The military press exercise machine of claim 10 and further comprising:

a second pair of weight holders located on opposite sides of the midplane, each second weight holder connected to a respective lever adjacent the rearward end thereof and adapted to apply a weight assistance thereto to assist pivotal upward movement thereof.

14. The military press exercise machine of claim 13 wherein each second weight holder further comprises:

a hub connected to the respective lever adjacent the rearward end thereof and adapted to hold selected number of weighted plates to provide the weight assistance.

* * * * *